US006298930B1

(12) United States Patent
Sinor et al.

(10) Patent No.: US 6,298,930 B1
(45) Date of Patent: Oct. 9, 2001

(54) DRILL BITS WITH CONTROLLED CUTTER LOADING AND DEPTH OF CUT

(75) Inventors: L. Allen Sinor, Kingwood, TX (US); Wayne R. Hansen, Centerville, UT (US); Mark W. Dykstra, Kingwood, TX (US); Craig H. Cooley, South Ogden; Gordon A. Tibbitts, Salt Lake City, both of UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/383,228

(22) Filed: Aug. 26, 1999

(51) Int. Cl.[7] ..... E21B 10/46

(52) U.S. Cl. ..... 175/428; 175/432; 175/431

(58) Field of Search ..... 175/428, 429, 175/431, 57, 363, 376, 378, 398, 432

(56) References Cited

U.S. PATENT DOCUMENTS

| | | |
|---|---|---|
| 1,805,678 | 5/1931 | Smith . |
| 2,198,849 | 4/1940 | Waxler . |
| 2,563,515 | 8/1951 | Brown . |
| 2,624,549 | 1/1953 | Wallace . |
| 2,684,835 | 7/1954 | Moore . |
| 2,776,817 | 1/1957 | Gregory et al. . |
| 3,153,458 | 10/1964 | Short . |
| 3,303,894 | 2/1967 | Varney . |
| 3,709,308 | 1/1973 | Rowley et al. . |
| 3,779,323 | 12/1973 | Horten et al. . |
| 4,351,401 | 9/1982 | Fielder . |
| 4,386,669 | 6/1983 | Evans . |
| 4,499,958 | 2/1985 | Radtke et al. . |
| 4,554,986 | 11/1985 | Jones . |
| 4,718,505 | 1/1988 | Fuller . |
| 4,763,737 | 8/1988 | Hellnick . |
| 4,889,017 | 12/1989 | Fuller et al. . |
| 4,981,184 | 1/1991 | Knowlton et al. . |
| 4,982,802 | 1/1991 | Warren et al. . |
| 4,991,670 | 2/1991 | Fuller et al. . |
| 5,010,789 | 4/1991 | Brett et al. . |
| 5,042,596 | 8/1991 | Brett et al. . |
| 5,090,492 | 2/1992 | Keith . |
| 5,111,892 | 5/1992 | Sinor et al. . |
| 5,131,478 | 7/1992 | Brett et al. . |
| 5,199,511 * | 4/1993 | Tibbitts et al. . |
| 5,244,039 * | 9/1993 | Newton, Jr. et al. . |

(List continued on next page.)

OTHER PUBLICATIONS

1995 Hughes Christensen 1995 Drill Bit Catalog, p. 31.
Hughes Christensen Bit Drawing dated May 29, 1997—HC Part No.CC201918.
Hughes Christensen Bit Drawing dated Sep. 18, 1996—HC Part No. CW210655.
Hughes Christensen Bit Drawing dated Sep. 18, 1996—HC Part No. CS205023.
Hughes Christensen Bit Drawing dated Sep. 9, 1996—HC Part No. CC20718.

*Primary Examiner*—Frank S. Tsay
(74) *Attorney, Agent, or Firm*—TraskBritt

(57) ABSTRACT

A rotary drag bit including exterior features to control the depth of cut by cutters mounted thereon, so as to control the volume of formation material cut per bit rotation as well as the torque experienced by the bit and an associated bottom-hole assembly. The exterior features preferably precede, taken in the direction of bit rotation, cutters with which they are associated, and provide sufficient bearing area so as to support the bit against the bottom of the borehole under weight on bit without exceeding the compressive strength of the formation rock. The exterior features may be oriented and configured to function optimally at a predicted rate of penetration, or range of rates, at which the bit may be operated, such rate or rates being further optionally maximized in softer formations in light of the ability of the bit to hydraulically clear a maximum volume of formation cuttings to prevent so-called bit balling.

59 Claims, 9 Drawing Sheets

U.S. PATENT DOCUMENTS 5,265,685 * 11/1993 Keith et al. .
5,303,785 * 4/1994 Duke .
5,314,033 * 5/1994 Tibbitts .
5,388,649 * 2/1995 Ilomäki .
5,402,856 * 4/1995 Warren et al. .
5,558,170 * 9/1996 Thigpen et al. .
5,595,252 * 1/1997 O'Hanlon .
5,730,234 3/1998 Putot .

* cited by examiner

DRILL BITS WITH CONTROLLED CUTTER LOADING AND DEPTH OF CUT

BACKGROUND OF THE INVENTION

1. Field of the Invention

The present invention relates to rotary drag bits and their operation and, more specifically, to the design of such bits for optimum performance in the context of controlling cutter loading and depth of cut.

2. State of the Art

Rotary drag bits employing polycrystalline diamond compact (PDC) cutters have been employed for several decades. PDC cutters are typically comprised of a disc-shaped diamond "table" formed on and bonded under high pressure, high temperature conditions to a supporting substrate such as cemented tungsten carbide (WC), although other configurations are known. Bits carrying PDC cutters, which may be brazed into pockets in the bit face or blades extending from the face or mounted to studs inserted into the bit body, have proven very effective in achieving high rates of penetration (ROP) in drilling subterranean formations exhibiting low to medium compressive strengths. Recent improvements in the hydraulic design of bits, cutter design and drilling fluid formulation have reduced prior, notable tendencies of such bits to "ball" by increasing the volume of formation material which may be cut before exceeding the ability of the bit and its associated drilling fluid flow to clear the formation cuttings from the bit face.

Even in view of such improvements, however, PDC cutters still suffer from what might simply be termed "overloading" even at low weight on bit (WOB) applied to the drill string to which the bit carrying such cutters is mounted, especially if aggressive cutting structures are employed. The relationship of torque to WOB may be employed as an indicator of aggressivity for cutters, so the higher the torque to WOB ratio, the more aggressive the cutter. This problem is particularly significant in low compressive strength formations where an unduly great depth of cut (DOC) may be achieved at extremely low WOB. The problem may also be aggravated by string bounce, wherein the elasticity of the drill string may cause erratic application of WOB to the drill bit, with consequent overloading. Moreover, operating PDC cutters at an excessively high DOC may generate more formation cuttings than can be consistently cleared from the bit face and through the junk slots by even the aforementioned improved, state-of-the-art bit hydraulics, leading to the aforementioned bit balling phenomenon.

Another, separate problem involves drilling from a zone or stratum of higher formation compressive strength to a "softer" zone of lower strength. As the bit drills into the softer formation without changing the applied WOB (or before the WOB can be changed by the directional driller), the penetration of the PDC cutters, and thus the resulting torque on the bit, increase almost instantaneously and by a substantial magnitude. The abruptly higher torque, in turn, may cause damage to the cutters. In directional drilling, such a change causes the tool face orientation of the directional (measuring while drilling, or MWD, or a steering tool) assembly to fluctuate, making it more difficult for the directional driller to follow the planned directional path for the bit and necessitating backing off from the bottom of the borehole to re-set the tool face. In addition, a downhole motor, such as the drilling fluid-driven Moineau motors commonly employed in directional drilling operations in combination with a steerable bottomhole assembly, may completely stall under a sudden torque increase, stopping the drilling operation and again necessitating backing off from the borehole bottom to re-establish drilling fluid flow and motor output.

Numerous attempts using varying approaches have been made over the years to protect the integrity of diamond cutters and their mounting structures, and to limit cutter penetration into a formation being drilled. For example, from a period even before the advent of commercial use of PDC cutters, U.S. Pat. No. 3,709,308 discloses the use of trailing, round natural diamonds on the bit body to limit the penetration of cubic diamonds employed to cut a formation. U.S. Pat. No. 4,351,401 discloses the use of surface set natural diamonds at or near the gage of the bit as penetration limiters to control the depth of cut of PDC cutters on the bit face. Other patents disclose the use of a variety of structures immediately trailing PDC cutters (with respect to the direction of bit rotation) to protect the cutters or their mounting structures: U.S. Pat. Nos. 4,889,017, 4,991,670, 5,244,039 and 5,303,785. U.S. Pat. No. 5,314,033 discloses, inter alia, the use of cooperating positive and negative or neutral backrake cutters to limit penetration of the positive rake cutters into the formation. Another approach to limiting cutting element penetration is to employ structures or features on the bit body rotationally preceding (rather than trailing) PDC cutters, as disclosed in U.S. Pat. Nos. 3,153,458, 4,554,986, 5,199,511 and 5,595,252.

In another context, that of so-called "anti-whirl" drilling structures, it has been asserted in U.S. Pat. No. 5,402,856 to one of the inventors herein that a bearing surface aligned with a resultant radial force generated by an anti-whirl underreamer should be sized so that force per area applied to the borehole sidewall will not exceed the compressive strength of the formation being underreamed. See also U.S. Pat. Nos. 4,982,802, 5,010,789, 5,042,596, 5,111,892 and 5,131,478.

While some of the foregoing patents recognize the desirability to limit cutter penetration or DOC, or otherwise limit force applied to a borehole surface, the disclosed approaches are somewhat generalized in nature and fail to accommodate or implement an engineered approach to achieving a target ROP in combination with more stable, predictable bit performance.

BRIEF SUMMARY OF THE INVENTION

The present invention addresses the foregoing needs by providing a well-reasoned, easily implementable bit design particularly suitable for PDC cutter-bearing drag bits, which bit design may be tailored to specific formation compressive strengths or strength ranges to provide DOC control in terms of both maximum DOC and limitation of DOC variability. As a result, continuously achievable ROP may be optimized and torque controlled even under high WOB, while destructive loading of the PDC cutters is largely prevented.

The bit design of the present invention employs depth of cut control (DOCC) features which may rotationally lead at least some of the PDC cutters on the bit face on which the bit may ride while the PDC cutters of the bit are engaged with the formation to their design DOC, which may be defined as the distance the PDC cutters are effectively exposed below the DOCC features. Stated another way, the cutter standoff is substantially controlled by the DOCC features, and such control may enable a relatively greater DOC (and thus ROP for a given bit rotational speed) than with a conventional bit design without the adverse consequences usually attendant thereto. The DOCC features preclude a greater DOC than that designed for by distributing the load attributable to WOB over a sufficient surface area on the bit face, blades or other bit body structure contacting the uncut formation face at the borehole bottom so that the compressive strength of the formation will not be exceeded by the DOCC features. As a result, the bit does not substantially indent, or fail, the formation rock and permit greater than intended cutter penetration and consequent increase in cutter loading and torque.

Stated another way, the present invention limits the unit volume of formation material (rock) removed, per bit rotation, to prevent the bit from over-cutting the formation material and balling the bit or damaging the cutters. If the bit is employed in a directional drilling operation, tool face loss or motor stalling is also avoided. In one embodiment, the DOCC features may be configured as arcuate segments, each segment substantially corresponding to a portion of a circular path traversed by an associated PDC cutter it precedes at substantially the same radius as the bit rotates, the outermost face, or bearing surface, of each arcuate segment DOCC feature being oriented (as the bit is normally situated during drilling) at an angle with respect to the bit centerline corresponding to the helical path traversed by its associated, trailing cutter for a given ROP or designed range of ROPs as the bit drills ahead into the formation. Further, the angle of the arcuate segment may be varied to accommodate a range of ROPs and associated range of helix angles. As will be explained in more detail hereafter, this design approach compensates for height offsets between a PDC cutter and an associated DOCC feature, such as might result from manufacturing tolerance errors during fabrication of the bit, or relatively inconsistent wear of the PDC cutter and the associated DOCC feature. By providing DOCC features having a cumulative surface area sufficient to support a given WOB on a given rock formation without indentation or failure of same, WOB may be dramatically increased, if desired, over that usable in drilling with conventional bits without the PDC cutters experiencing any additional effective WOB after the DOCC features are in full contact with the formation. Thus, the PDC cutters are protected from damage and, equally significant, prevented from engaging the formation to a greater depth of cut and consequently generating excessive torque which might stall a motor or cause loss of tool face orientation.

The ability to dramatically increase WOB without adversely affecting the PDC cutters also permits the use of WOB substantially above and beyond the magnitude applicable without adverse effects to conventional bits to maintain the bit in contact with the formation, reduce vibration and enhance the consistency and depth of cutter engagement with the formation. In addition, drill string vibration as well as dynamic axial effects, commonly termed "bounce", of the drill string under applied torque and WOB may be damped so as to maintain the design DOC for the PDC cutters. Again, in the context of directional drilling, this capability ensures maintenance of tool face and stall-free operation of an associated downhole motor driving the bit.

It is specifically contemplated that DOCC features according to the present invention may be applied to coring bits as well as full bore drill bits. As used herein, the term "bit" encompasses core bits. Such usage may be, by way of example only, particularly beneficial when coring from a floating drill rig where WOB is difficult to control because of wave action-induced rig heave. When using the present invention, a WOB in excess of that normally required for coring may be applied to the drill string to keep the core bit on bottom and maintain core integrity and orientation.

It is also specifically contemplated that DOCC features according to the present invention have particular utility in controlling, and specifically reducing, torque required to rotate rotary drag bits as WOB is increased. While relative torque may be reduced in comparison to that required by conventional bits for a given WOB by employing the DOCC features at any radius or radii range from the bit centerline, variation in placement of DOCC features with respect to the bit centerline may be a useful technique for further limiting torque since the axial loading on the bit from applied WOB is more heavily emphasized toward the centerline and the frictional component of the torque is related to such axial loading.

BRIEF DESCRIPTION OF THE SEVERAL VIEWS OF THE DRAWINGS

FIG. 2 is a side sectional elevation of the profile of the bit of FIG. 2A;

DETAILED DESCRIPTION OF THE INVENTION

Figure 1:
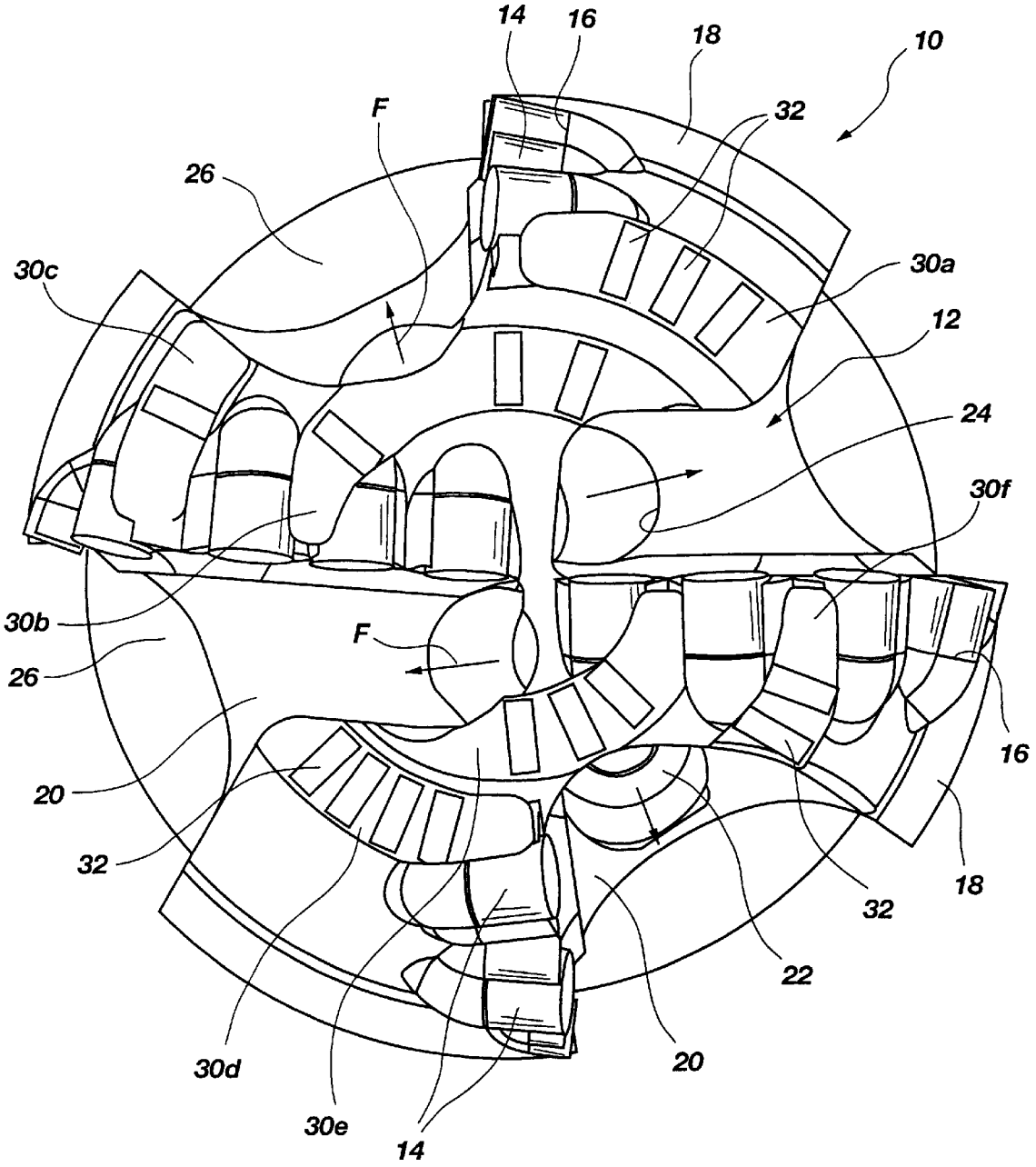
FIG. 1 is a bottom elevation looking upward at the face of one embodiment of a drill bit including DOCC features according to the invention.

FIG. 1 of the drawings depicts a rotary drag bit 10 looking upwardly at its face or leading end 12 as if the viewer were positioned at the bottom of a borehole. Bit 10 includes a plurality of PDC cutters 14 bonded by their substrates (diamond tables and substrates not shown separately for clarity), as by brazing, into pockets 16 in blades 18 extending above the face 12, as is known in the art with respect to the fabrication of so-called "matrix" type bits. Such bits include a mass of metal powder, such as tungsten carbide, infiltrated with a molten, subsequently hardenable binder, such as a copper-based alloy. It should be understood, however, that the present invention is not limited to matrix-type bits, and that steel body bits and bits of other manufacture may also be configured according to the present invention.

Figure 2:
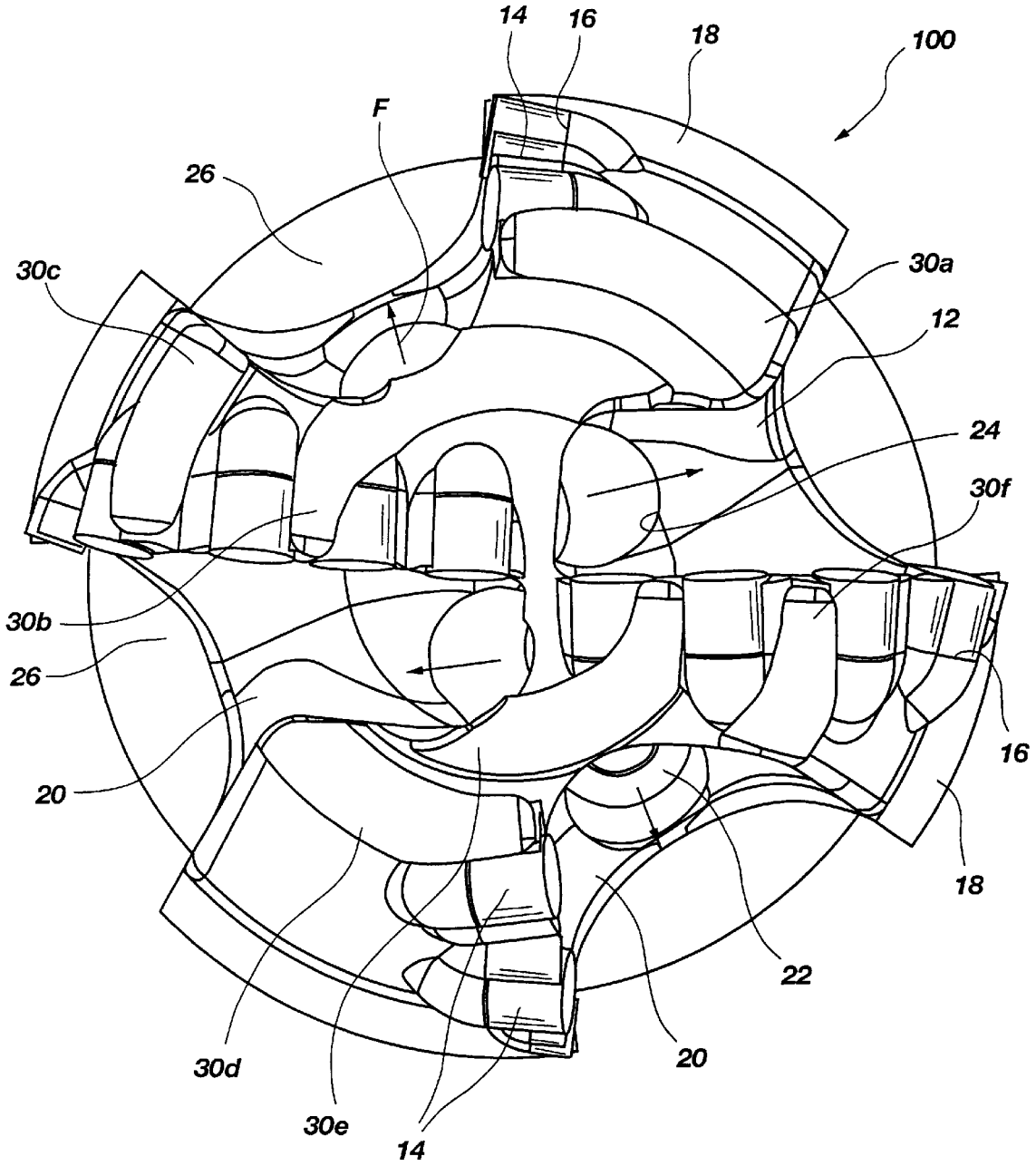
FIG. 2 is a bottom elevation looking upward at the face of another embodiment of a drill bit including DOCC features according to the invention.
Figure 2A:
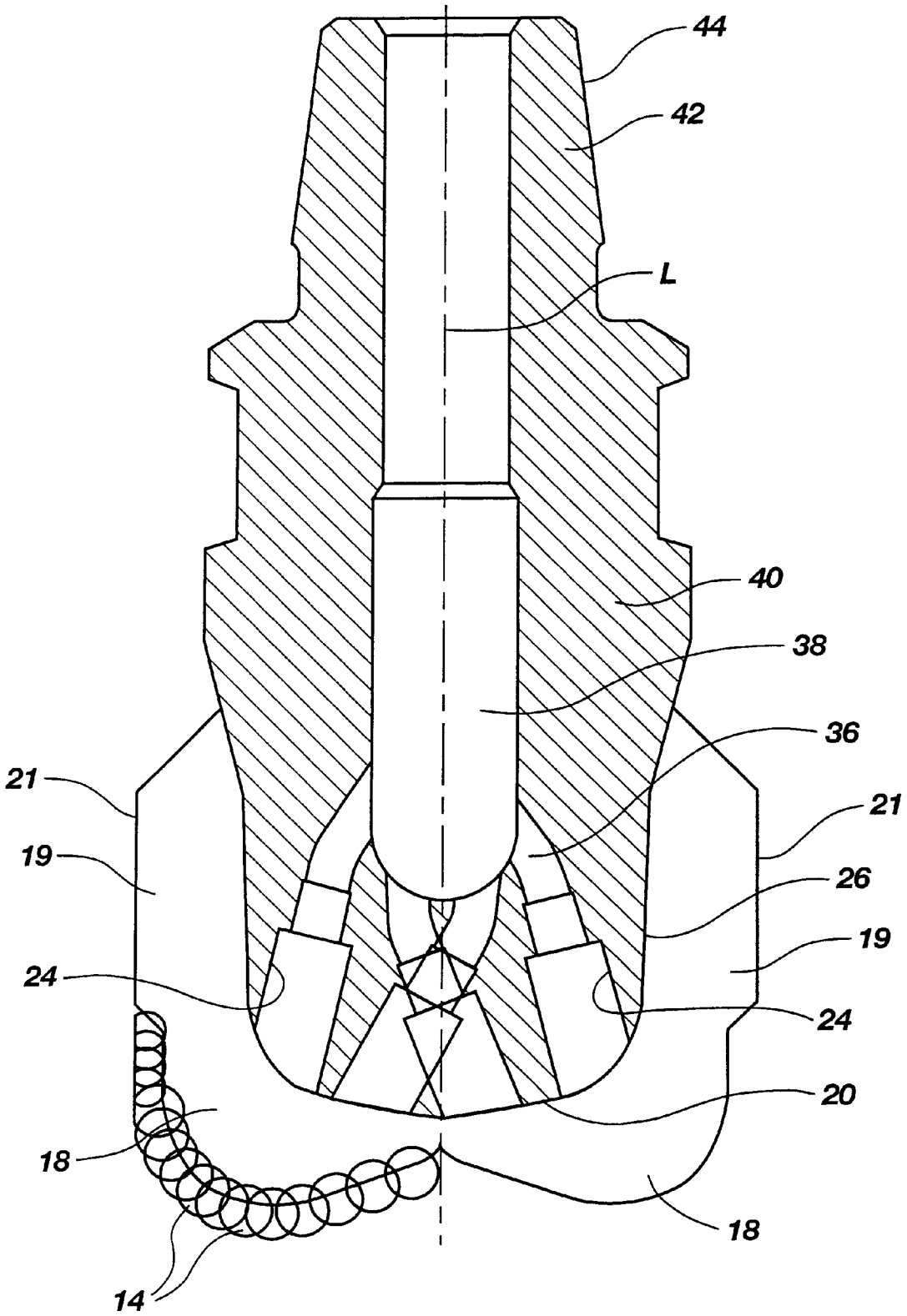

Fluid courses 20 lie between blades 18, and are provided with drilling fluid by nozzles 22 secured in nozzle orifices 24, orifices 24 being at the end of passages leading from a plenum extending into the bit body from a tubular shank at the upper, or trailing, end of the bit (see FIG. 2A in conjunction with the accompanying text for a description of these features). Fluid courses 20 extend to junk slots 26 extending upwardly along the side of bit 10 between blades 18. Gage pads 19 comprise longitudinally upward extensions of blades 18, and may have wear resistant inserts or coatings on radially outer surfaces 21 thereof as known in the art. Formation cuttings are swept away from PDC cutters 14 by drilling fluid F emanating from nozzles 22 which move generally radially outwardly through fluid courses 20 and then upwardly through junk slots 26 to an annulus between the drill string from which the bit 10 is suspended, and onto the surface.

A plurality of DOCC features, each comprising an arcuate bearing segment 30*a* through 30*f* sometimes collectively referred to by the number "30", reside on, and in some instances bridge between, blades 18. Specifically, bearing segments 30*b* and 30*e* each reside partially on an adjacent blade 18 and extend therebetween. The arcuate bearing segments 30*a* through 30*f*, each of which lies along substantially the same radius from the bit centerline as a PDC cutter 14 rotationally trailing that bearing segment 30, together provide sufficient surface area to withstand the axial or longitudinal WOB without exceeding the compressive strength of the formation being drilled, so that the rock does not indent or fail and the penetration of PDC cutters 14 into the rock is substantially controlled. As can be seen in FIG. 1, wear resistant elements or inserts 32, in the form of tungsten carbide bricks or discs, diamond grit, diamond film, or natural or synthetic diamond (PDC or TSP), or cubic boron nitride, may be added to the exterior bearing surfaces of bearing segments 30 to reduce the abrasive wear thereof by contact with the formation under WOB as the bit 10 rotates under applied torque. In lieu of inserts, the bearing surfaces may be comprised of, or completely covered with, a wear-resistant material. The significance of wear characteristics of the DOCC features will be explained in more detail below.

FIGS. 2 and 2A depict another embodiment 100 of a rotary drill bit according to the present invention, and features and elements in FIGS. 2 and 2A corresponding to those identified with respect to bit 10 of FIG. 1 are identified with the same reference numerals. FIG. 2 depicts a rotary drag bit 100 looking upwardly at its face 12 as if the viewer were positioned at the bottom of a borehole. Bit 100 also includes a plurality of PDC cutters 14 bonded by their substrates (diamond tables and substrates not shown separately for clarity), as by brazing, into pockets 16 in blades 18 extending above the face 12 of bit 100.

Fluid courses 20 lie between blades 18, and are provided with drilling fluid F by nozzles 22 secured in nozzle orifices 24, orifices 24 being at the end of passages 36 leading from a plenum 38 extending into bit body 40 from a tubular shank 42 threaded (not shown) on its exterior surface 44 as known in the art at the upper end of the bit (see FIG. 2A). Fluid courses 20 extend to junk slots 26 extending upwardly along the side of bit 10 between blades 18. Gage pads 19 comprise longitudinally upward extensions of blades 18, and may have wear resistant inserts or coatings on radially outer surfaces 21 thereof as known in the art.

A plurality of DOCC features, each comprising an arcuate bearing segment 30*a* through 30*f*, reside on, and in some instances bridge between, blades 18. Specifically, bearing segments 30*b* and 30*e* each reside partially on an adjacent blade 18 and extend therebetween. The arcuate bearing segments 30*a* through 30*f*, each of which lies substantially along the same radius from the bit centerline as a PDC cutter 14 rotationally trailing that bearing segment 30, together provide sufficient surface area to withstand the axial or longitudinal WOB without exceeding the compressive strength of the formation being drilled, so that the rock does not indent or fail and the penetration of PDC cutters 14 into the rock is substantially controlled.

By way of example only, the total DOCC feature surface area for an 8.5 inch diameter bit generally configured as shown in FIGS. 1 and 2 may be about 12 square inches. If, for example, the unconfined compressive strength of a relatively soft formation to be drilled by either bit 10 or 100 is 2,000 pounds per square inch (psi), then at least about 24,000 lbs. WOB may be applied without failing or indenting the formation. Such WOB is far in excess of the WOB which may normally be applied to a bit in such formations (for example, as little as 1,000 to 3,000 lbs., up to about 5,000 lbs.) without incurring bit balling from excessive DOC and the consequent cuttings volume which overwhelms the bit's hydraulic ability to clear them. In harder formations, with, for example, 20,000 to 40,000 psi compressive strengths, the total DOCC feature surface area may be significantly reduced while still accommodating substantial WOB applied to keep the bit firmly on the borehole bottom. When older drill rigs are employed or during directional drilling, both of which render it difficult to control WOB with any substantial precision, the ability to overload with WOB without adverse consequences further distinguishes the superior performance of bits according to the invention. It should be noted at this juncture that the use of an unconfined compressive strength of formation rock provides a significant margin for calculation of the required bearing area of DOCC features for a bit, as the in situ, confined, compressive strength of a subterranean formation being drilled is substantially higher. Thus, if desired, confined compressive strength may be employed in designing total DOCC feature bearing area to yield a smaller required area, but which still advisedly provides for an adequate "margin" of excess bearing area in recognition of variations in continued compressive strength to preclude substantial indentation and failure of the formation downhole.

Figure 13A:
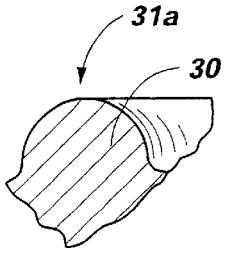
FIGS. 13A, 13B and 13C are transverse sections of various cross-sectional configurations for DOCC features according to the invention.
Figure 13B:
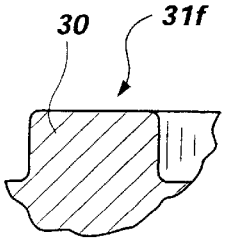
Figure 13C:
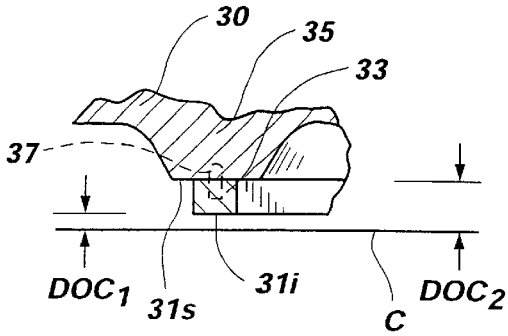

While bit 100 is notably similar to bit 10, the viewer will recognize and appreciate that wear resistant inserts 32 are omitted from bearing segments on bit 100, such an arrangement being suitable for less abrasive formations where wear is of lesser concern and the tungsten carbide of the bit matrix (or applied hardfacing in the case of a steel body bit) is sufficient to resist abrasive wear for a desired life of the bit. As shown in FIG. 13A, the DOCC features (bearing segments) 30 of either bit 10 or bit 100, or of any bit according to the invention, may be of arcuate cross-section, taken transverse to the arc followed as the bit rotates, to provide an arcuate bearing surface 31*a* mimicking the cutting edge arc of an unworn, associated PDC cutter following a DOCC feature. Alternatively, as shown in FIG. 13B, a DOCC feature 30 may exhibit a flat bearing surface 31*f* to the formation, or may be otherwise configured. It is also contemplated, as shown in FIG. 13C, that a DOCC feature 30 may be cross-sectionally configured and comprised of a material so as to intentionally and relatively quickly (in comparison to the wear rate of a PDC cutter) wear from a smaller initial bearing surface 31*i* providing a relatively small DOC, with respect to the point or line of contact C with the formation traveled by the cutting edge of a trailing, associated PDC cutter while drilling a first, hard formation interval to a larger, secondary bearing surface 31*s* which also provides a much smaller $DOC_2$ for a second, lower, much softer (and lower compressive strength) formation interval. Alternatively, the head 33 of DOCC structure 30 may be made controllably shearable from the base 35 (as with frangible connections like a shear pin, one shear pin 37 shown in broken lines).

For reference purposes, bits 10 and 100, as illustrated, may be said to be symmetrical or concentric about their centerlines or longitudinal axes L, although this is not necessarily a requirement of the invention.

Both bits 10 and 100 are unconventional in comparison to state of the art bits in that PDC cutters 14 on bits 10 and 100 are disposed at far lesser backrakes, in the range of, for example, 7° to 15° . In comparison, many conventional bits are equipped with cutters at a 30° backrake, and a 20° backrake is regarded as somewhat "aggressive" in the art. The presence of the DOCC features permits the use of substantially more aggressive backrakes, as the DOCC features preclude the aggressively-raked PDC cutters from penetrating the formation to too great a depth, as would be the case in a bit without the DOCC features.

In the cases of both bit 10 and bit 100, the rotationally leading DOCC features 30 are configured and placed to substantially exactly match the pattern drilled in the bottom of the borehole when drilling at an ROP of 100 feet per hour (fph) at 120 rotations per minute (rpm) of the bit. This results in a DOC of about 0.166 inch per revolution. Due to the presence of the DOCC features 30, after sufficient WOB has been applied to drill 100 fph, any additional WOB is transferred from the body 40 of the bit 10 or 100 through the DOCC features to the formation. Thus, the cutters 14 are not exposed to any substantial additional weight, unless and until a WOB sufficient to fail the formation being drilled would be applied, which application may be substantially controlled by the driller, since the DOCC features may be engineered to provide a large margin of error with respect to any given sequence of formations which might be encountered when drilling an interval. As a further consequence of the present invention, the DOCC features would, as noted above, preclude cutters 14 from excessively penetrating or "gouging" the formation, a major advantage when drilling with a downhole motor where it is often difficult to control WOB and WOB inducing such excessive penetration can result in the motor stalling, with consequent loss of tool face and possible damage to motor components as well as to the bit itself. While addition of WOB beyond that required to achieve the desired ROP will require additional torque to rotate the bit due to frictional resistance to rotation of the DOCC features over the formation, such additional torque is a lesser component of the overall torque.

Figure 3:
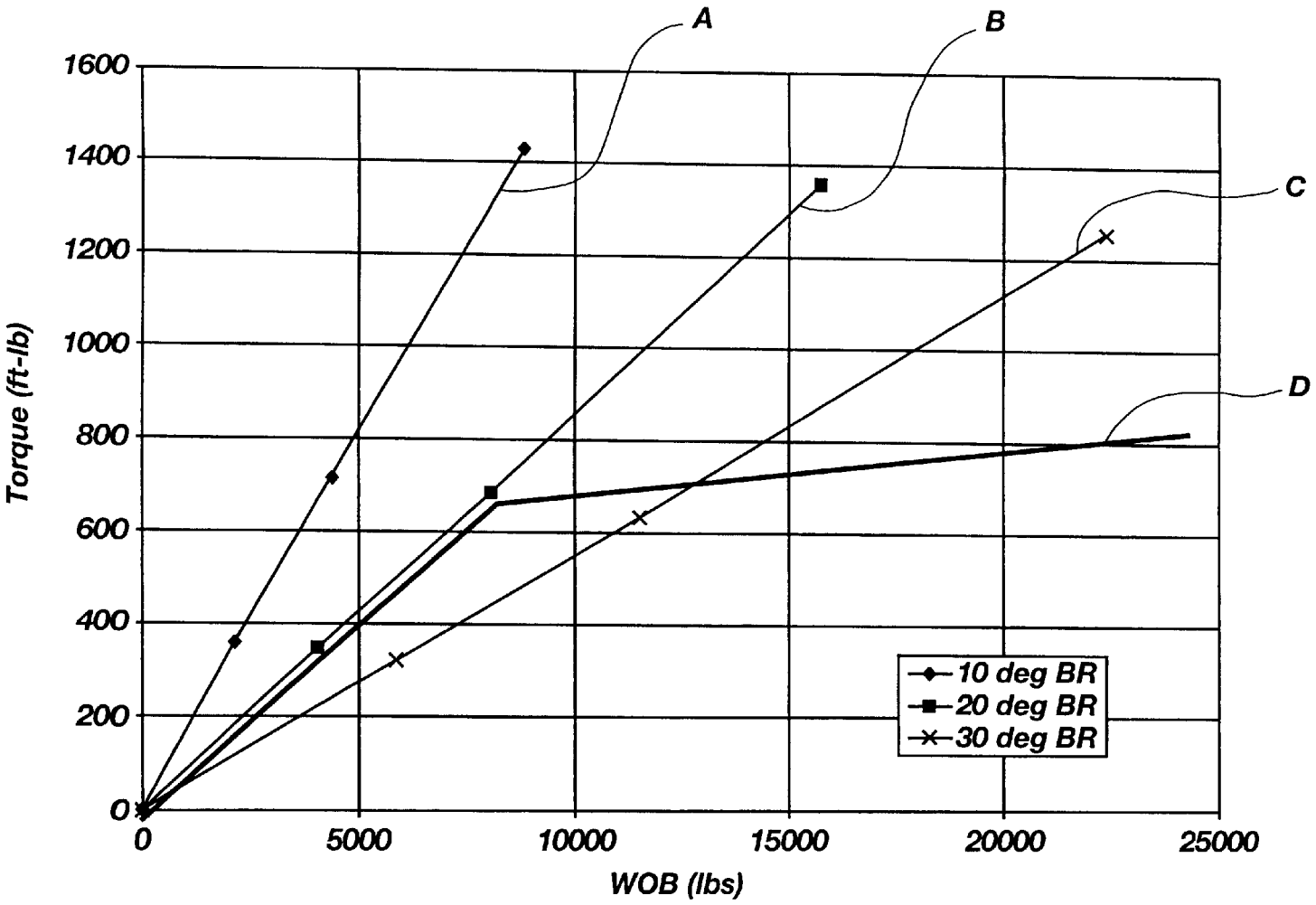
FIG. 3 is a graph depicting mathematically predicted torque versus WOB for conventional bit designs employing cutters at different backrakes versus a similar bit according to the present invention.

The benefit of DOCC features in controlling torque can readily be appreciated by a review of FIG. 3 of the drawings, which is a mathematical model of performance of a 3 ¾ inch diameter, four-bladed, Hughes Christensen R324XL PDC bit showing various torque versus WOB curves for varying cutter backrakes in drilling Mancos Shale. Curve A represents the bit with a 10° cutter backrake, curve B, the bit with a 20° cutter backrake, curve C, the bit with a 30° cutter backrake, and curve D, the bit using cutters disposed at a 20° backrake and including DOCC features according to the present invention. The model assumes a bit design according to the invention for an ROP of 50 fph at 100 rpm, which provides 0.1 inch per revolution penetration of a formation being drilled. As can readily be seen, regardless of cutter backrake, curves A through C clearly indicate that, absent DOCC features according to the present invention, required torque on the bit continues to increase continuously and substantially linearly with applied WOB, regardless of how much WOB is applied. On the other hand, curve D indicates that, after WOB approaches about 8,000 lbs. on the bit, including DOCC features, the torque curve flattens significantly and increases in a substantially linear manner only slightly from about 670 ft-lb. to just over 800 ft-lb., even as WOB approaches 25,000 lbs. As noted above, this relatively small increase in the torque after the DOCC features engage the formation is frictionally related, and is also somewhat predictable. As graphically depicted in FIG. 3, this additional torque load increases substantially linearly as a function of WOB times the coefficient of friction between the bit and the formation, and is substantially independent of the contact area therebetween.

Figure 4:
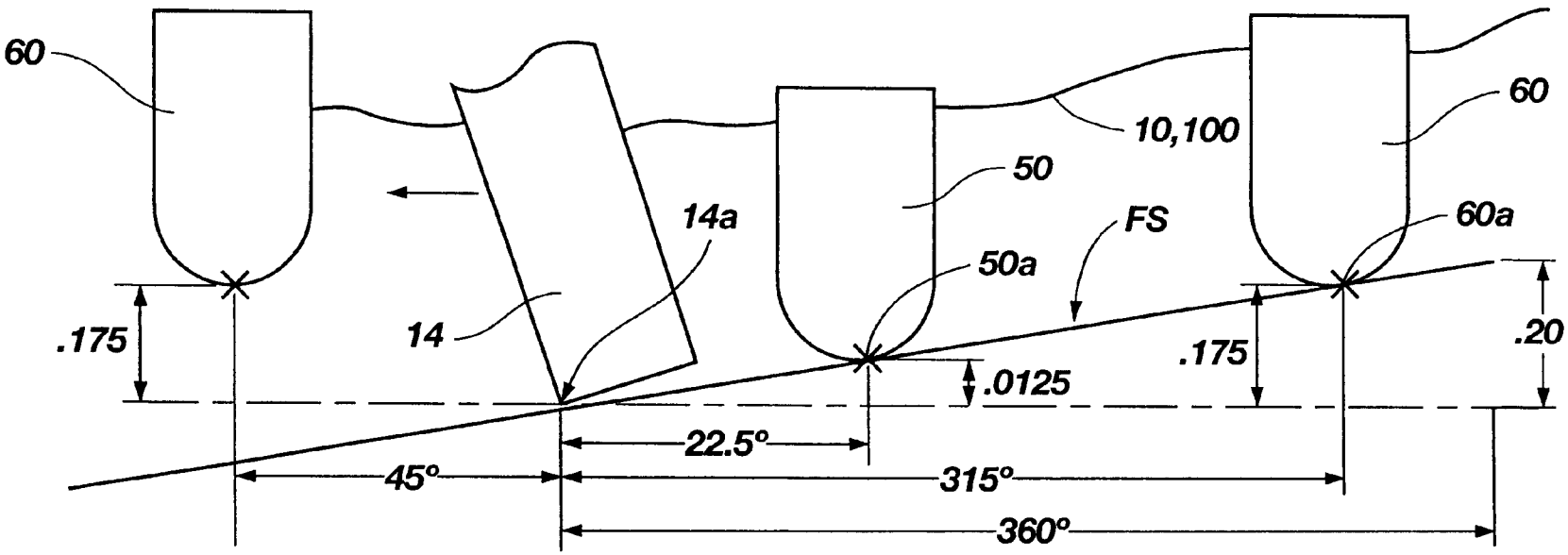
FIG. 4 is a schematic side elevation, not to scale, comparing prior art placement of a depth of cut limiting structure closely behind a cutter at the same radius, taken along a 360° rotational path, versus placement according to the present invention preceding the cutter and at the same radius.

Referring now to FIG. 4 (which is not to scale) of the drawings, a further appreciation of the operation and benefits of the DOCC features according to the present invention may be obtained. Assuming a bit is designed for an ROP of 120 fph at 120 rpm, this requires an average DOC of 0.20 inch. The DOCC features or DOC limiters would thus be designed to first contact the subterranean formation surface FS to provide a 0.20 inch DOC. It is assumed for the purposes of FIG. 4 that DOCC features or DOC limiters are sized so that compressive strength of the formation being drilled is not exceeded under applied WOB. As noted previously, the compressive strength of concern would typically be the in situ compressive strength of the formation rock resident in the formation being drilled (plus some safety factor), rather than unconstrained compressive strength of a rock sample. In FIG. 4, an exemplary PDC cutter 14 is shown, for convenience, moving linearly right to left on the page. One complete revolution of the bit 10 or 100 on which PDC cutter 14 is mounted has been "unscrolled" and laid out flat in FIG. 4. Thus, as shown, PDC cutter 14 has progressed downwardly (i.e., along the longitudinal axis of the bit 10 or 100 on which it is mounted) 0.20 inch in 360° of rotation of the bit 10 or 100. As shown in FIG. 4, a structure or element 50 to be used as a DOC limiter is located conventionally, closely rotationally "behind" PDC cutter 14, as only 22.5° behind PDC cutter 14 and, the outermost tip 50*a* must be recessed upwardly 0.0125 inch (0.20 inch DOC×22.5°/360°) from the outermost tip 14*a* of PDC cutter 14 to achieve an initial 0.20 inch DOC. However, when DOC limiter 50 wears during drilling, for example by a mere 0.010 inch relative to the tip 14*a* of PDC cutter 14, the vertical offset distance between the tip 50*a* of DOC limiter 50 and tip 14*a* of PDC cutter 14 is increased to 0.0225 inch. Thus, DOC will be substantially increased, in fact, almost doubled, to 0.36 inch. Potential ROP would consequently equal 216 fph due to the increase in vertical standoff provided PDC cutter 14 by worn DOC limiter 50, but the DOC increase may damage PDC cutter 14 or ball the bit 10 or 100 by generating a volume of formation cuttings which overwhelms the bit's ability to clear them hydraulically. Similarly, if PDC cutter tip 14*a* wore at a relatively faster rate than DOC limiter 50 by, for example, 0.010 inch, the vertical offset distance is decreased to 0.0025 inch, DOC is reduced to 0.04 inch and ROP, to 24 fph. Thus, excessive wear or vertical misplacement of either PDC cutter 14 or DOC limiter 50 to the other may result in a wide range of possible ROPs for a given rotational speed. On the other hand, if an exemplary DOCC feature 60 is placed according to the present invention, 45° rotationally in front of (or 315° rotationally behind) PDC cutter tip 14*a,* the outermost tip 60*a* would initially be recessed upwardly 0.175 inch (0.20 inch DOC×315°/360°) relative to PDC cutter tip 14*a* to provide the initial 0.20 inch DOC. FIG. 4 shows the same DOCC feature 60 twice, both rotationally in front of and behind PDC cutter 14, for clarity, it being, of course, understood that the path of PDC cutter 14 is circular throughout a 360° arc in accordance with rotation of bit 10 or 100. When DOCC feature 60 wears 0.010 inch relative to PDC cutter tip 14*a,* the vertical offset distance between tip 60*a* of DOCC feature 60 and tip 14*a* of PDC cutter 14 is only increased from 0.175 inch to 0.185 inch. However, due to the placement of DOCC feature 60 relative to PDC cutter 14, DOC will be only slightly increased, to about 0.211 inch. As a consequence, ROP would only increase to about 127 fph. Likewise, if PDC cutter 14 wears 0.010 inch relative to DOCC feature 60, vertical offset of DOCC feature 60 is only reduced to 0.165 inch and DOC is only reduced to about 0.189 inch, with an attendant ROP of about 113 fph. Thus, it can readily be seen how rotational placement of a DOCC feature can significantly affect ROP as the limiter or the cutter wears with respect to the other, or if one such component has been misplaced or incorrectly sized to protrude incorrectly even slightly upwardly or downwardly of its ideal, or "design", position relative to the other, associated component when the bit is fabricated. Similarly, mismatches in wear between a cutter and a cutter-trailing DOC limiter are magnified in the prior art, while being significantly reduced when DOCC features sized and placed in cutter-leading positions according to the present invention are employed. Further, if a DOC limiter trailing, rather than leading, a given cutter is employed, it will be appreciated that shock or impact loading of the cutter is more probable as, by the time the DOC limiter contacts the formation, the cutter tip will have already contacted the formation. Leading DOCC features, on the other hand, by being located in advance of a given cutter along the downward helical path the cutter travels as it cuts the formation and the bit advances along its longitudinal axis, tend to engage the formation before the cutter. The terms "leading" and "trailing" the cutter may be easily understood as being preferably respectively associated with DOCC feature positions up to 180° rotationally preceding a cutter versus positions up to 180° rotationally trailing a cutter. While some portion of, for example, an elongated, arcuate leading DOCC feature according to the present invention may extend so far rotationally forward of an associated cutter so as to approach a trailing position, the substantial majority of the arcuate length of such a DOCC feature would preferably reside in a leading position. As may be appreciated by further reference to FIGS. 1 and 2, there may be a significant rotational spacing between a PDC cutter 14 and an associated bearing segment 30 of a DOCC feature, as across a fluid course 20 and its associated junk slot 26, while still rotationally leading the PDC cutter 14. More preferably, at least some portion of a DOCC feature according to the invention will lie within about 90° rotationally preceding the face of an associated cutter.

One might question why limitation of ROP would be desirable, as bits according to the present invention using DOCC features may not, in fact, drill at as great an ROP as conventional bits not so equipped. However, as noted above, by using DOCC features to achieve a predictable and substantially sustainable DOC in conjunction with a known ability of a bit's hydraulics to clear formation cuttings from the bit at a given maximum volumetric rate, a sustainable (rather than only peak) maximum ROP may be achieved without bit balling and with reduced cutter wear and substantial elimination of cutter damage and breakage from excessive DOC, as well as impact-induced damage and breakage. Motor stalling and loss of tool face may also be eliminated. In soft or ultra-soft formations very susceptible to balling, limiting the unit volume of rock removed from the formation per unit time prevents a bit from "over cutting" the formation. In harder formations, the ability to apply additional WOB in excess of what is needed to achieve a design DOC for the bit may be used to suppress vibration normally induced by the PDC cutters and their cutting action, as well as drill string vibration in the form of bounce, manifested on the bit by an excessive DOC. In such harder formations, the DOCC features may also be characterized as "load arresters" used in conjunction with "excess" WOB to protect the PDC cutters from vibration-induced damage, the DOCC features again being sized so that the compressive strength of the formation is not exceeded. In harder formations, the ability to damp out vibrations and bounce by maintaining the bit in constant contact with the formation is highly beneficial in terms of bit stability and longevity, while in steerable applications the invention precludes loss of tool face.

Figure 5:
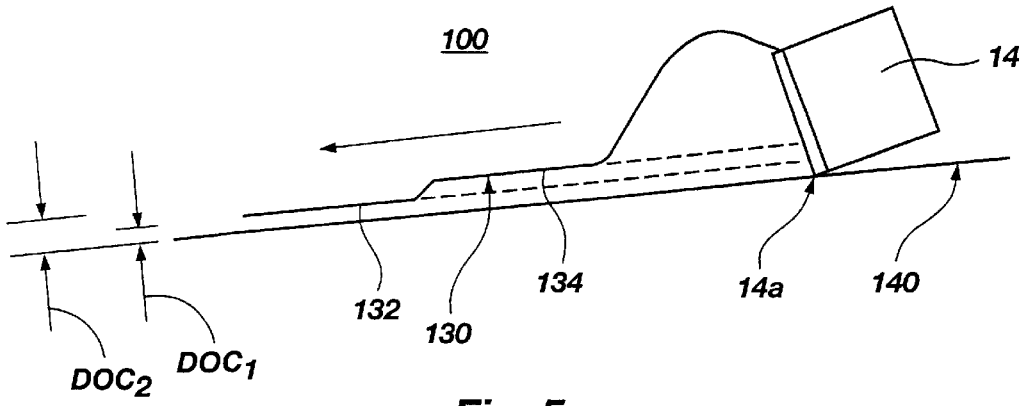
FIG. 5 is a schematic side elevation of a two-step DOCC feature and associated trailing PDC cutter.

FIG. 5 depicts one exemplary variation of a DOCC feature according to the present invention, which may be termed a "stepped" DOCC feature 130 comprising an elongated, arcuate bearing segment. Such a configuration, shown for purposes of illustration preceding a PDC cutter 14 on a bit 100 (by way of example only), includes a lower, rotationally leading first step 132 and a higher, rotationally trailing second step 134. As tip 14*a* of PDC cutter 14 follows its downward helical path generally indicated by line 140 (the path, as with FIG. 4, being unscrolled on the page), the surface area of first step 132 may be used to limit DOC in a harder formation with a greater compressive strength, the bit "riding" high on the formation with cutter 14 taking a minimal $DOC_1$ in the formation surface, shown by the lower dashed line. However, as bit 100 enters a much softer formation with a far lesser compressive strength, the surface area of first step 132 will be insufficient to prevent indentation and failure of the formation, and so first step 132 will indent the formation until the surface of second step 134 encounters the formation material, increasing DOC by cutter 14. At that point, the total surface area of first and second steps 132 and 134 (in combination with other first and second steps respectively associated with other cutters 14) will be sufficient to prevent further indentation of the formation and the deeper $DOC_2$ in the surface of the softer formation (shown by the upper dashed line) will be maintained until the bit 100 once again encounters a harder formation. When this occurs, the bit 100 will ride up on the first step 132, which will take any impact from the encounter before cutter 14 encounters the formation, and the DOC will be reduced to its previous DOC level, avoiding excessive torque and motor stalling.

Figure 6A:
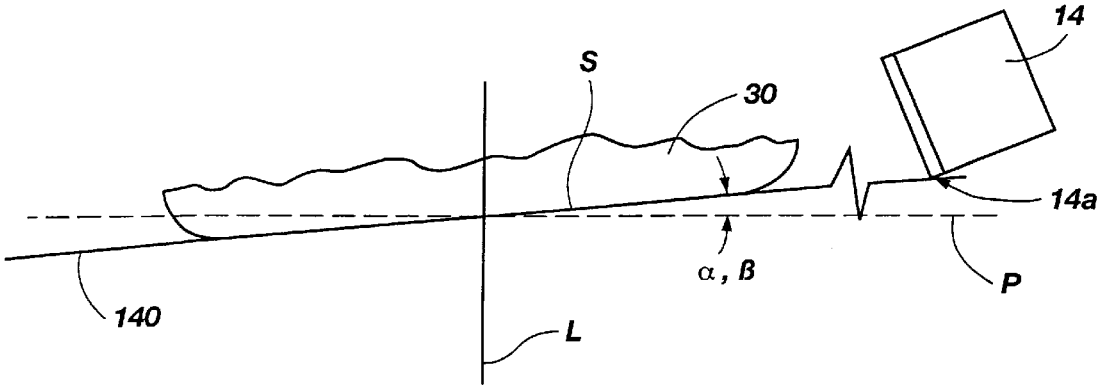
FIGS. 6A and 6B are, respectively, schematics of single-angle bearing surface and multi-angle bearing surface DOCC features.
Figure 6B:
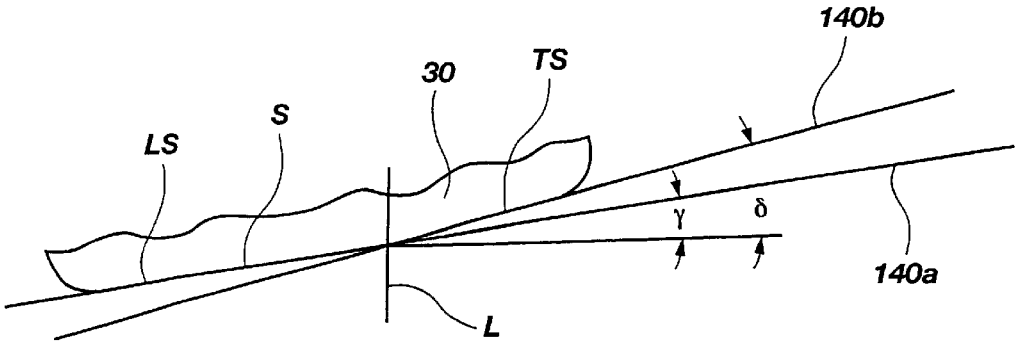

As shown in FIGS. 1 and 2, one or more DOCC features of a bit according to the invention may comprise elongated arcuate bearing segments 30 disposed at substantially the same radius about the bit longitudinal axis or centerline as a cutter preceded by that DOCC feature. In such an instance, and as depicted in FIG. 6A with exemplary arcuate bearing segment 30 unscrolled to lie flat on the page, it is preferred that the outer, bearing surface S of a segment 30 be sloped at an angle $\alpha$ to a plane P transverse to the centerline L of the bit substantially the same as the angle $\beta$ of the helical path 140 traveled by associated PDC cutter 14 as the bit drills the borehole. By so orienting outer surface S, the full potential surface, or bearing, area of bearing segment 30 contacts and remains in contact with the formation as the PDC cutter rotates. As shown in FIG. 6B, the outer surface S of an arcuate segment may also be sloped at a variable angle to accommodate maximum and minimum design ROP for a bit. Thus, if a bit is designed to drill between 110 and 130 fph, the rotationally leading portion LS of surface S may be at one, relatively shallower angle $\gamma$, while the rotationally trailing portion TS of surface S (all of surface S still rotationally leading PDC cutter 14) may be at another, relatively steeper angle $\delta$, (both angles shown in exaggerated magnitude for clarity) the remainder of surface S gradually transitioning in angle therebetween. In this manner, and since DOC must necessarily increase for ROP to increase, given a substantially constant rotational speed, at a first, shallower helix angle 140*a* corresponding to a lower ROP, the leading portion LS of surface S will be in contact with the formation being drilled, while at a higher ROP the helix angle will steepen, as shown (exaggerated for clarity) by helix angle 140*b,* and leading portion LS will no longer contact the formation, the contact area being transitioned to more steeply angled trailing portion TS. Of course, at an ROP intermediate the upper and lower limits of the design range, a portion of surface S intermediate leading portion LS and trailing portion TS (or portions of both LS and TS) would act as the bearing surface. A configuration as shown in FIG. 6B is readily suitable for high compressive strength formations at varying ROP's within a design range, since bearing surface area requirements for the DOCC features are nominal. For bits used in drilling softer formations, it may be necessary to provide excess surface area for each DOCC feature to prevent formation failure and indentation, as only a portion of each DOCC feature will be in contact with the formation at any one time when drilling over a design range of ROPs.

Another consideration in the design of bits according to the present invention is the abrasivity of the formation being drilled, and relative wear rates of the DOCC features and the PDC cutters. In non-abrasive formations, this is not of major concern, as neither the DOCC feature nor the PDC cutter will wear appreciably. However, in more abrasive formations, it may be necessary to provide wear resistant inserts 32 (see FIG. 1) or otherwise protect the DOCC features against excessive (i.e., premature) wear in relation to the cutters with which they are associated to prevent reduction in DOC. For example, if the bit is a matrix-type bit, a layer of diamond grit may be embedded in the outer surfaces of the DOCC features. Alternatively, preformed cemented tungsten carbide slugs cast into the bit face may be used as DOCC features. A diamond film may be formed on selected portions of the bit face using known chemical vapor deposition techniques as known in the art, or diamond films formed on substrates which are then cast into, or brazed or otherwise bonded to the bit body. Natural diamonds, thermally stable PDCs (commonly termed TSPs) or even PDCs with their faces substantially parallel to the helix angle of the cutter path (so that what would normally be the cutting face of the PDC acts as a bearing surface), or cubic boron nitride structures similar to the aforementioned diamond structures may also be employed on, or as, bearing surfaces of the DOCC features, as desired or required, for example when drilling in limestones and dolomites. In order to reduce frictional forces between a DOCC bearing surface and the formation, a very low roughness, so-called "polished" diamond surface may be employed in accordance with U.S. Pat. Nos. 5,447,208 and 5,653,300, assigned to the assignee of the present invention and hereby incorporated herein by this reference. Ideally, and taking into account wear of the diamond table and supporting substrate in comparison to wear of the DOCC features, the wear characteristics and volumes of materials taking the wear for the DOCC features may be adjusted so that the wear rate of the DOCC features may be substantially matched to the wear rate of the PDC cutters to maintain a substantially constant DOC. This approach will result in the ability to use the PDC cutter to its maximum potential life. It is, of course, understood that the DOCC features may be configured as abbreviated "knots" or large "mesas" as well as the aforementioned arcuate segments, or of any other configuration suitable for the formation to be drilled to prevent failure thereof by the DOCC features under expected or planned WOB.

As an alternative to a fixed, or passive, DOCC feature, it is also contemplated that active DOCC features or bearing segments may be employed to various ends. For example, rollers may be disposed in front of the cutters to provide a reduced-friction DOCC feature, or a fluid bearing comprising an aperture surrounded by a pad or mesa on the bit face may be employed to provide a standoff for the cutters with attendant low friction. Movable DOCC features, for example pivotable structures, might also be used to accommodate variations in ROP within a given range by tilting the bearing surfaces of the DOCC features so that the surfaces are oriented at the same angle as the helical path of the associated cutters.

Referring now to FIGS. 7 through 12 of the drawings, various DOCC features (which may also be referred to as bearing segments) according to the invention are disclosed.

Figure 7:
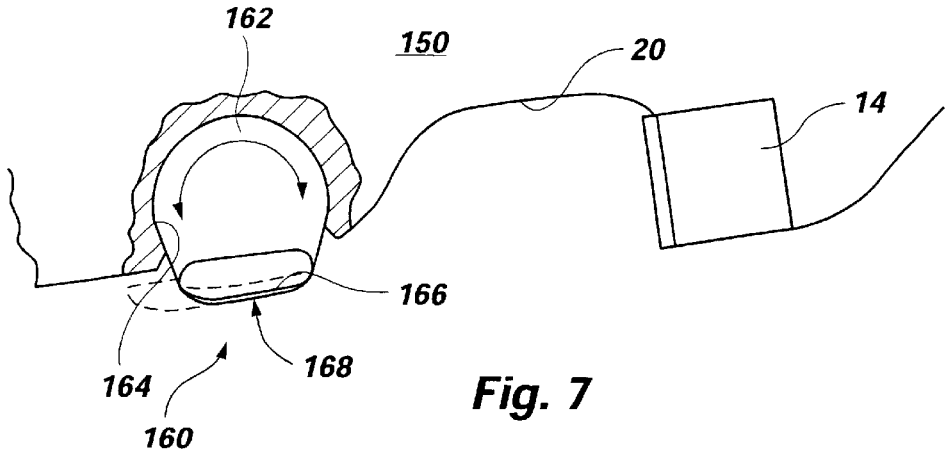
FIGS. 7 and 7A are, respectively, a schematic side partial sectional elevation of an embodiment of a pivotable DOCC feature and associated trailing PDC cutter, and an elevation looking forward at the pivotable DOCC feature from the location of the associated PDC cutter.
Figure 7A:
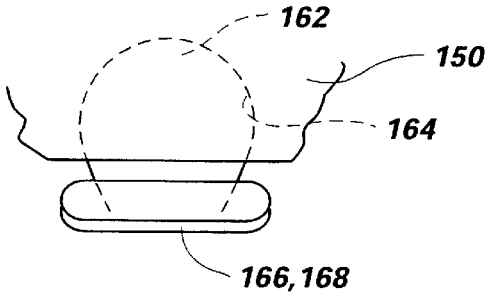

Referring to FIGS. 7 and 7A, exemplary bit 150 having PDC cutter 14 secured thereto rotationally trailing fluid course 20 includes pivotable DOCC feature 160 comprised of arcuate-surfaced body 162 (which may comprise a hemisphere for rotation about several axes or merely an arcuate surface extending transverse to the plane of the page for rotation about an axis transverse to the page) secured in socket 164 and having optional wear-resistant feature 166 on the bearing surface 168 thereof. Wear resistant feature 166 may merely be an exposed portion of the material of body 162 if the latter is formed of, for example, WC. Alternatively, wear-resistant feature 166 may comprise a WC tip, insert or cladding on bearing surface 168 of body 162, diamond grit embedded in body 162 at bearing surface 168, or a synthetic or natural diamond surface treatment of bearing surface 168, including specifically and without limitation a diamond film deposited thereon or bonded thereto. It should be noted that the area of the bearing surface 168 of the DOCC feature which will ride on the formation being drilled, as well as the DOC for PDC cutter 14, may be easily adjusted for a given bit design by using bodies 162 exhibiting different exposures (heights) of the bearing surface and different widths, lengths or cross-sectional configurations, all as shown in broken lines. Thus, different formation compressive strengths may be accommodated. The use of a pivotable DOCC feature 160 permits the DOCC feature to automatically adjust to different ROPs within a given range of cutter helix angles. While DOC may be affected by pivoting of the DOCC feature 160, variation within a given range of ROPs will usually be nominal.

Figure 8:
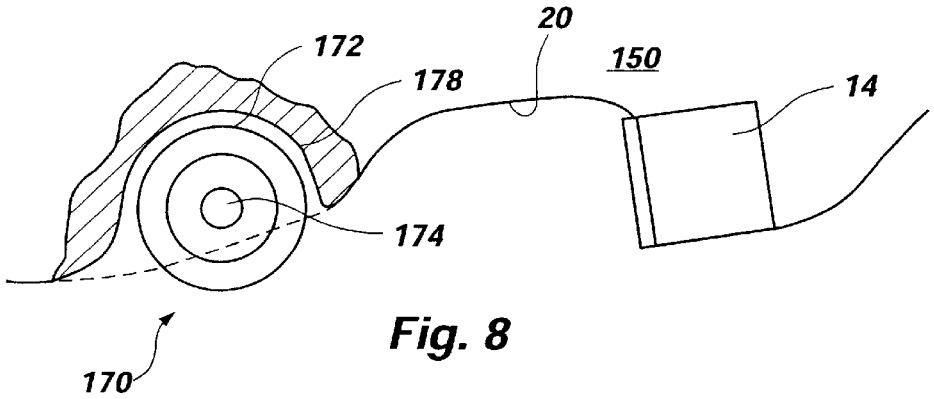
FIGS. 8 and 8A are, respectively, a schematic side partial sectional elevation of an embodiment of a roller-type DOCC feature and associated trailing cutter, and a transverse partial cross-sectional view of the mounting of the roller-type DOCC feature to the bit.
Figure 8A:
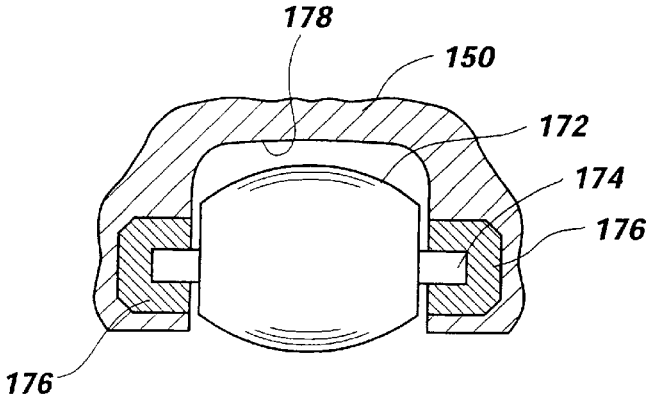
Figure 9A:
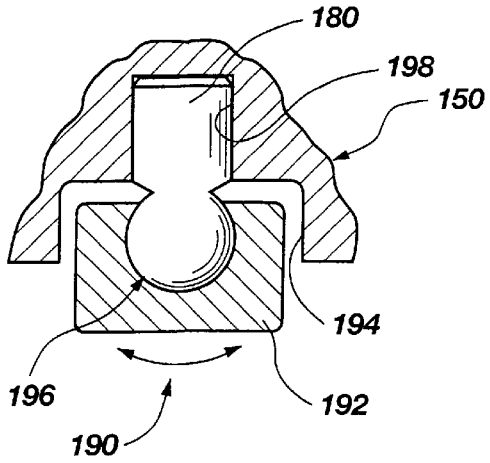
FIGS. 9A–9D depict additional schematic partial sectional elevations of further pivotable DOCC features according to the invention.
Figure 9B:
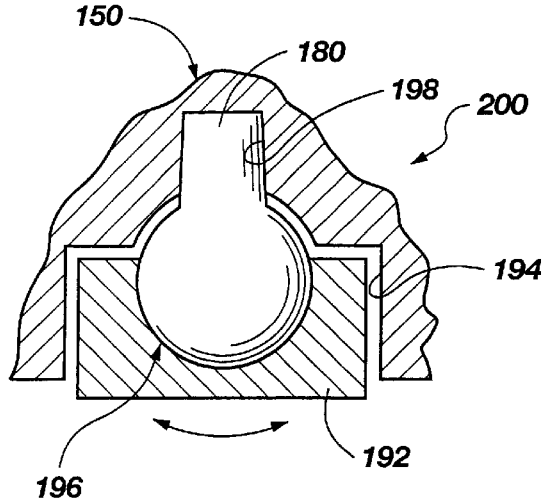
Figure 9C:
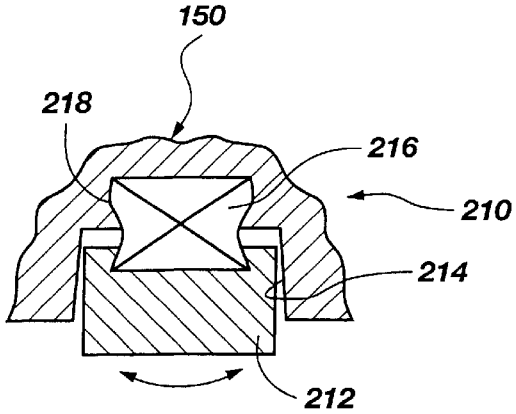
Figure 9D:
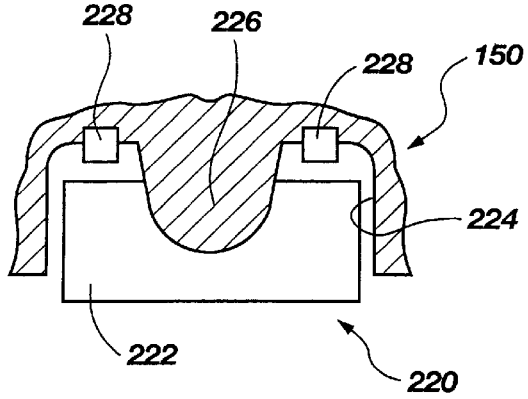

FIGS. 8 and 8A depict exemplary bit 150 having PDC cutter 14 secured thereto rotationally trailing fluid course 20, wherein bit 150 in this instance includes DOCC feature 170 including roller 172 rotationally mounted by shaft 174 to bearings 176 carried by bit 150 on each side of cavity 178 in which roller 172 is partially received. In this embodiment, it should be noted that the exposure and bearing surface area of DOCC feature 170 may be easily adjusted for a given bit design by using different diameter rollers 172 exhibiting different widths and/or cross-sectional configurations.

FIGS. 9A, 9B, 9C and 9D respectively depict alternative pivotable DOCC features 190, 200, 210 and 220. DOCC feature 190 includes a head 192 partially received in a cavity 194 in a bit 150 and mounted through a ball and socket connection 196 to a stud 180 press-fit into aperture 198 at the top of cavity 194. DOCC feature 200, wherein elements similar to those of DOCC feature 190 are identified by the same reference numerals, is a variation of DOCC feature 190. DOCC feature 210 employs a head 212 which is partially received in a cavity 214 in a bit 150 and secured thereto by a resilient or ductile connecting element 216 which extends into aperture 218 at the top of cavity 214. Connecting element 216 may comprise, for example, an elastomeric block, a coil spring, a belleville spring, a leaf spring, or a block of ductile metal, such as steel or bronze. Thus, connecting element 216, as with the ball and socket connections 196 and heads 192, permits head 212 to automatically adjust to, or compensate for, varying ROPs defining different cutter helix angles. DOCC feature 220 employs a yoke 222 rotationally disposed and partially received within cavity 224, yoke 222 supported on protrusion 226 of bit 150. Stops 228, of resilient or ductile materials (such as elastomers, steel, lead, etc.) and which may be permanent or replaceable, permit yoke 226 to accommodate various helix angles. Yoke 226 may be secured within cavity 224 by any conventional means. Since helix angles vary even for a given, specific ROP as distance of each cutter from the bit centerline, affording such automatic adjustment or compensation may be preferable to trying to form DOCC features with bearing surfaces at different angles at different locations over the bit face.

Figure 10A:
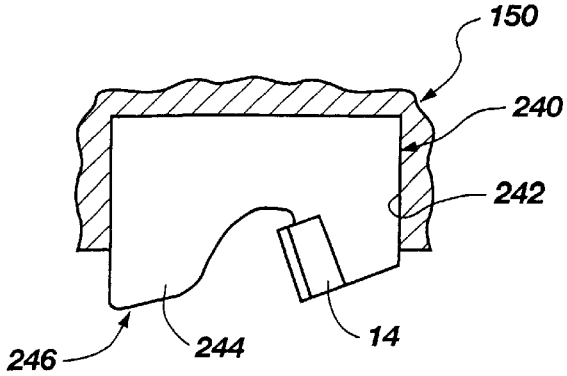
FIGS. 10A and 10B are schematic side partial sectional elevations of variations of a combination cutter carrier and DOCC feature according to the present invention.
Figure 10B:
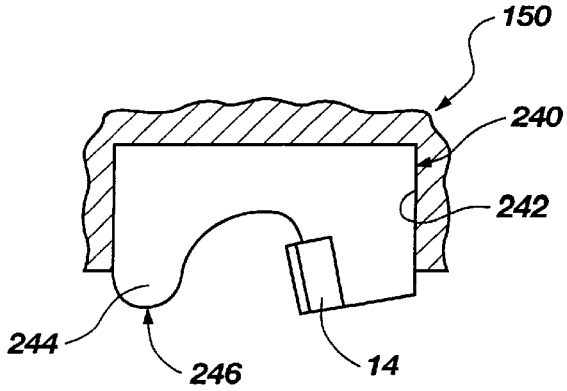

FIGS. 10A and 10B respectively depict different DOCC feature and PDC cutter combinations. In each instance, a PDC cutter 14 is secured to a combined cutter carrier and DOC limiter 240, the carrier 240 being received within a cavity 242 in the face (or on a blade) of an exemplary bit 150 and secured therein as by brazing, welding, mechanical fastener, or otherwise as known in the art. DOC limiter 240 includes a protrusion 244 exhibiting a bearing surface 246. As shown and by way of example only, bearing surface 246 may be substantially flat (FIG. 10A) or hemispherical (FIG. 10B). By selecting an appropriate cutter carrier and DOC limiter 240, the DOC of PDC cutter 14 may be varied and the surface area of bearing surface 246 adjusted to accommodate a target formation's compressive strength.

It should be noted that the DOCC features of FIGS. 7 through 10, in addition to accommodating different formation compressive strengths as well as optimizing DOC and permitting minimization of friction-causing bearing surface area while preventing formation failure under WOB, also facilitate field repair and replacement of DOCC features due to drilling damage or to accommodate different formations to be drilled in adjacent formations, or intervals, to be penetrated by the same borehole.

Figure 11:
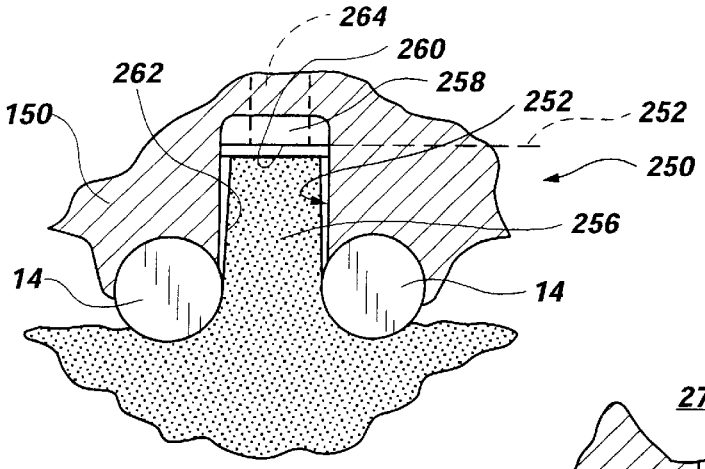
FIG. 11 is a frontal elevation of an annular channel-type DOCC feature in combination with associated trailing PDC cutters.

FIG. 11 depicts a DOCC feature 250 comprised of an annular cavity channel 252 channel in the face of an exemplary bit 150. Radially adjacent PDC cutters 14 flanking annular channel 252 cut the formation 254 but for uncut annular segment 256, which protrudes into annular cavity 252. At the top 260 of annular channel 252, a flat-edged PDC cutter 258 (or preferably a plurality of rotationally-spaced cutters 258) truncates annular formation segment 256 in a controlled manner so that the height of annular segment 256 remains substantially constant and limits the DOC of flanking PDC cutters 14. In this instance, the bearing surface of the DOCC feature 250 comprises the top 260 of annular channel 252, and the sides 262 of channel 252 prevent collapse of annular formation segment 256. Of course, it is understood that multiple annular channels 252 with flanking cutters 14 may be employed, and that a source of drilling fluid, such as aperture 264, would be provided to lubricate channel 252 and flush formation cuttings from cutter 258.

Figure 12:
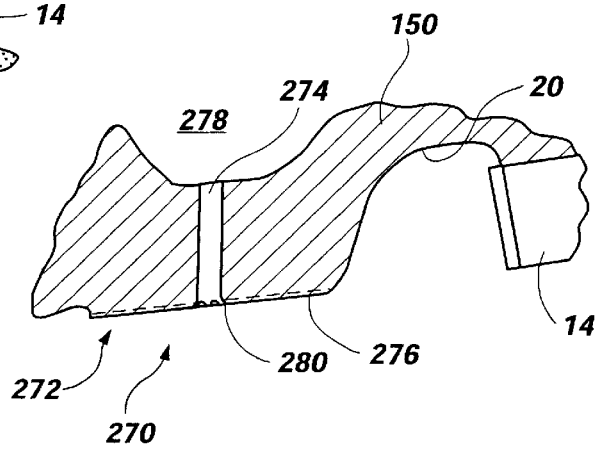
FIGS. 12 and 12A are, respectively, a schematic side partial sectional elevation of a fluid bearing pad-type DOCC feature according to the present invention and an associated trailing PDC cutter, and an elevation looking upwardly at the bearing surface of the pad.
Figure 12A:
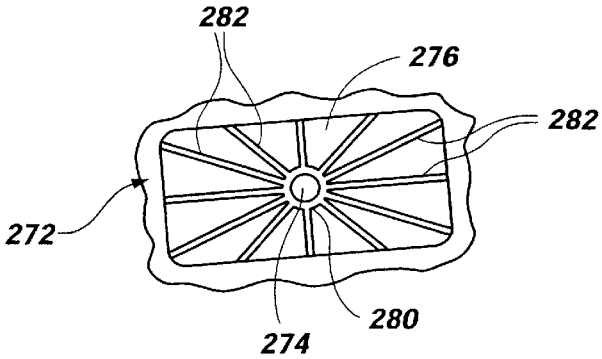

FIGS. 12 and 12A depict a low-friction, hydraulically-enhanced DOCC feature 270 comprised of a DOCC pad 272 rotationally leading a PDC cutter 14 across fluid course 20 on exemplary bit 150, pad 272 being provided with drilling fluid through passage 274 leading to the bearing surface 276 of pad 272 from a plenum 278 inside the body of bit 150. As shown in FIG. 12A, a plurality of channels 282 may be formed on bearing surface 276 to facilitate distribution of drilling fluid from the mouth 280 of passage 274 across bearing surface 276. By diverting a small portion of drilling fluid flow to the bit from its normal path leading to nozzles associated with the cutters, it is believed that the increased friction normally attendant with WOB increases after the bearing surface 276 of DOCC pad 272 contacts the formation may be at least somewhat alleviated, and in some instances substantially avoided, reducing or eliminating torque increases responsive to increases of WOB. Of course, passages 274 may be sized to provide appropriate flow, or pads 272 sized with appropriately-dimensioned mouths 280. Pads 272 may, of course, be configured for replaceability.

As has been mentioned above, backrakes of the PDC cutters employed in a bit equipped with DOCC features according to the invention may be more aggressive, that is to say, less negative, than with conventional bits. It is also contemplated that extremely aggressive cutter rakes, including neutral rakes and even positive (forward) rakes of the cutters may be successfully employed consistent with the cutters' inherent strength to withstand the loading thereon as a consequence of such rakes, since the DOCC features will prevent such aggressive cutters from engaging the formation to too great a depth.

It is also contemplated that two different heights, or exposures, of bearing segments may be employed on a bit, a set of higher bearing segments providing a first bearing surface area supporting the bit on harder, higher compressive strength formations providing a relatively shallow DOC for the PDC cutters of the bit, while a set of lower bearing segments remains out of contact with the formation while drilling until a softer, lower compressive stress formation is encountered. At that juncture, the higher or more exposed bearing segments will be of insufficient surface area to prevent indentation (failure) of the formation rock under applied WOB. Thus, the higher bearing segments will indent the formation until the second set of bearing segments comes in contact therewith, whereupon the combined surface area of the two sets of bearing segments will support the bit on the softer formation, but at a greater DOC to permit the cutters to remove a greater volume of formation material per rotation of the bit and thus generate a higher ROP for a given bit rotational speed. This approach differs from the approach illustrated in FIG. 5 in that, unlike stepped bearing segment 130, bearing segments of differing heights or exposures are associated with different cutters. Thus, this aspect of the invention may be effected, for example, in the bits 10 and 100 of FIGS. 1 and 2 by fabricating selected arcuate bearing segments to a greater height or exposure than others. Thus, bearing segments 30*b* and 30*e* of bits 10 and 100 may exhibit a greater exposure than segments 30*a*, 30*c*, 30*d* and 30*f*, or vice versa.

Cutters employed with bits 10 and 100 referenced herein have been described as PDC cutters, but it will be recognized and appreciated by those of ordinary skill in the art that the invention may also be practiced on bits carrying other superabrasive cutters, such as thermally stable polycrystalline diamond compacts, or TSPs, for example, arranged into a mosaic pattern as known in the art to simulate the cutting face of a PDC. Diamond film cutters may also be employed, as well as cubic boron nitride compacts.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility in both full bore bits and core bits, and with different and various bit profiles as well as cutter types, configurations and mounting approaches.

What is claimed is:

1. A drill bit for subterranean drilling, comprising:

a bit body including a leading end for contacting a formation during drilling and a trailing end having structure associated therewith for connecting the drill bit to a drill string;

at least one superabrasive cutter secured to the bit body over the leading end at a radius from a centerline of the bit body; and exterior structure on the leading end disposed substantially at the radius and exhibiting sufficient surface area, when in contact with the formation, to control penetration of the at least one superabrasive cutter into the formation under weight on bit by distributing the weight on bit so as to maintain a unit load on the formation below a compressive strength thereof.

2. The drill bit of claim 1, wherein the at least one superabrasive cutter comprises a plurality of superabrasive cutters, each of the plurality of superabrasive cutters positioned at a radius from the centerline, and the exterior structure on the leading end comprises a plurality of bearing segments having bearing surfaces and protruding from the bit body, each bearing segment of the plurality disposed substantially at the radius of one of the plurality of superabrasive cutters, wherein a combination of bearing surfaces of bearing segments of the plurality exhibits the sufficient surface area.

3. The drill bit of claim 2, wherein at least some of the bearing segments of the plurality are each leading, as taken in a direction of bit rotation, one superabrasive cutter of the plurality of superabrasive cutters.

4. The drill bit of claim 3, wherein the at least some of the bearing segments of the plurality are elongated and each of the at least some of the bearing segments defines an arc extending substantially along a single radius.

5. The drill bit of claim 4, wherein the at least some of the bearing segments of the plurality are of arcuate cross-section, taken transverse to a direction of elongation.

6. The drill bit of claim 4, wherein the bearing surfaces of each of the at least some elongated bearing segments of the plurality are oriented on at least one angle to a plane transverse to the centerline of the bit body, the at least one angle being substantially the same as an angle of a path traveled by a superabrasive cutter at substantially the same radius as that elongated bearing segment when the drill bit is drilling at a given rate of penetration.

7. The drill bit of claim 6, wherein the bearing surfaces of each of the at least some elongated bearing segments of the plurality are oriented on at least two angles to a plane transverse to the centerline of the bit body, the at least two angles being substantially the same as at least two angles of paths traveled by a superabrasive cutter at substantially the same radius as that elongated bearing segment when the drill bit is drilling at two different rates of penetration.

8. The drill bit of claim 7, wherein the bearing surfaces of each of the at least some elongated bearing segments of the plurality include a leading bearing surface portion at a relatively lesser angle to the plane and a trailing bearing surface portion at a relatively greater angle to the plane.

9. The drill bit of claim 3, wherein each superabrasive cutter led by a bearing segment is carried on a preformed structure having that bearing segment formed thereon.

10. The drill bit of claim 2, wherein the bearing surfaces of at least some of the bearing segments of the plurality protrude from the bit body to at least two different heights.

11. The drill bit of claim 2, wherein the bearing surfaces of at least some of the bearing segments protrude from the bit body to a first height and the bearing surfaces of at least others of the bearing segments protrude from the bit body to a second, different height.

12. The drill bit of claim 2, wherein at least one of the bearing segments of the plurality is pivotably mounted to the bit body.

13. The drill bit of claim 2, wherein at least one of the bearing segments of the plurality is rotatably mounted to the bit body.

14. The drill bit of claim 2, wherein at least one of the bearing segments of the plurality comprises a pad having a bearing surface with an aperture opening thereinto extending from an internal passage in the bit body.

15. The drill bit of claim 2, wherein at least some portions of the bearing surfaces of at least some of the bearing segments of the plurality are provided with wear-resistant structures.

16. The drill bit of claim 15, wherein the wear-resistant structures are selected from the group comprising tungsten carbide inserts, polycrystalline diamond compacts, thermally stable polycrystalline diamond compacts, natural diamonds, diamond grit, diamond film, and cubic boron nitride compacts.

17. A drill bit for subterranean drilling, comprising:

a bit body including a leading end for contacting a formation during drilling and a trailing end having structure associated therewith for connecting the drill bit to a drill string;

at least one superabrasive cutter secured to the bit body over the leading end at a radius from a centerline of the bit body; and at least one feature on the leading end disposed substantially at the radius and sized and configured so as to limit a depth of cut of the at least one superabrasive cutter into the formation through distribution of an axial load applied to the drill bit during drilling over a surface area sufficient to avoid failure of the formation.

18. The drill bit of claim 17, wherein the at least one superabrasive cutter comprises a plurality of superabrasive cutters, each of the plurality of superabrasive cutters positioned at a radius from the centerline, and the at least one feature on the leading end comprises a plurality of bearing segments having bearing surfaces and protruding from the bit body, each bearing segment of the plurality disposed substantially at the radius of one of the plurality of superabrasive cutters, wherein a combination of bearing surfaces of bearing segments of the plurality is sized and configured to provide the sufficient surface area.

19. The drill bit of claim 18, wherein at least some of the bearing segments of the plurality are each leading, as taken in a direction of bit rotation, one superabrasive cutter of the plurality of superabrasive cutters.

20. The drill bit of claim 19, wherein the at least some of the bearing segments of the plurality are elongated and each of the at least some of the bearing segments of the plurality defines an arc extending substantially along a single radius.

21. The drill bit of claim 20, wherein the at least some of the bearing segments of the plurality are of arcuate cross-section, taken transverse to a direction of elongation.

22. The drill bit of claim 20, wherein the bearing surfaces of each of the at least some elongated bearing segments of the plurality are oriented on at least one angle to a plane transverse to the centerline of the bit body, the at least one angle being substantially the same as an angle of a path traveled by a superabrasive cutter at substantially the same radius as that elongated bearing segment when the drill bit is drilling at a given rate of penetration.

23. The drill bit of claim 22, wherein the bearing surfaces of each of the at least some elongated bearing segments of the plurality are oriented on at least two angles to a plane transverse to the centerline of the bit body, the at least two angles being substantially the same as at least two angles of paths traveled by a superabrasive cutter at substantially the same radius as that elongated bearing segment when the drill bit is drilling at two different rates of penetration.

24. The drill bit of claim 23, wherein the bearing surfaces of each of the at least some elongated bearing segments of the plurality include a leading bearing surface portion at a relatively lesser angle to the plane and a trailing bearing surface portion at a relatively greater angle to the plane.

25. The drill bit of claim 19, wherein each superabrasive cutter led by a bearing segment is carried on a preformed structure having that segment formed thereon.

26. The drill bit of claim 18, wherein the bearing surfaces of at least some of the bearing segments of the plurality protrude from the bit body to at least two different heights.

27. The drill bit of claim 18, wherein the bearing surfaces of at least some of the bearing segments of the plurality protrude from the bit body to a first height and the bearing surfaces of at least others of the bearing segments of the plurality protrude from the bit body to a second, different height.

28. The drill bit of claim 18, wherein at least one of the bearing segments of the plurality is pivotably mounted to the bit body.

29. The drill bit of claim 18, wherein at least one of the bearing segments of the plurality is rotatably mounted to the bit body.

30. The drill bit of claim 18, wherein at least one of the bearing segments of the plurality comprises a pad having a bearing surface with an aperture opening thereinto extending from an internal passage in the bit body.

31. The drill bit of claim 18, wherein at least some portions of the bearing surfaces of at least some of the bearing segments of the plurality are provided with wear-resistant structures.

32. The drill bit of claim 31, wherein the wear-resistant structures are selected from the group comprising tungsten carbide inserts, polycrystalline diamond compacts, thermally stable polycrystalline diamond compacts, natural diamonds, diamond grit, diamond film, and cubic boron nitride compacts.

33. A drill bit for subterranean drilling, comprising:

a bit body including a longitudinal axis and a leading end for contacting a formation during drilling and a trailing end having structure associated therewith for connecting the drill bit to a drill string;

at least one superabrasive cutter secured to the bit body over the leading end at a radius from the longitudinal axis; and at least one exterior feature for controlling penetration of the at least one superabrasive cutter into the formation on the leading end on the same radius as and rotationally preceding the at least one superabrasive cutter, the at least one exterior feature being configured as an arcuate bearing segment.

34. The drill bit of claim 33, wherein the at least one exterior feature includes a bearing surface for contacting the formation, the bearing surface being sloped at an angle determined at least in part by an extent of the penetration of the at least one superabrasive cutter controlled by the at least one exterior feature and an intended rotational speed for the drill bit.

35. The drill bit of claim 33, wherein the at least one superabrasive cutter comprises a plurality of superabrasive cutters and the at least one exterior feature comprises a plurality of exterior features, each exterior feature associated with a superabrasive cutter and comprising an arcuate segment, the plurality of arcuate segments together exhibiting a surface area sufficient, when engaged with the formation under weight on bit, to prevent failure of formation material thereunder.

36. The drill bit of claim 33, wherein the at least one superabrasive cutter comprises a plurality of superabrasive cutters and the at least one exterior feature comprises a plurality of exterior features, each exterior feature associated with a superabrasive cutter and comprising an arcuate segment, the plurality of arcuate segments together exhibiting a surface to sufficiently distribute weight on bit so as to achieve a unit load on the formation less than a compressive strength thereof.

37. A method of designing a bit for subterranean drilling, comprising:

determining a compressive strength of at least one formation to be drilled;

selecting a plurality of superabrasive cutters required on the bit under design to drill a borehole;

determining a total weight on bit required to cause the plurality of superabrasive cutters to penetrate the at least one formation; and determining a surface area for at least one exterior feature on a leading end of the bit over which the plurality of superabrasive cutters is mounted sufficient to support the bit thereon under a weight on bit at least as great as the total weight on bit without failure of the at least one formation.

38. The method of claim 37, wherein the weight on bit is at least as great as the total weight on bit comprises a greater weight than the total weight on bit.

39. The method of claim 37, further comprising selecting a depth of cut for the plurality of superabrasive cutters and disposing the at least one exterior feature to preclude penetration of the at least one formation to a magnitude greater than the selected depth of cut.

40. The method of claim 39, further comprising determining a maximum volume of formation cuttings per unit time which may be cleared from the bit, given a number, size, disposition and orientation of a plurality of nozzles associated with the bit and under a selected flow rate of drilling fluid to be made available to the bit when drilling the at least one formation, and determining a maximum rotational speed required to generate the maximum volume of formation cuttings by the plurality of superabrasive cutters at the selected depth of cut.

41. The method of claim 37, further comprising determining a maximum volume of formation cuttings per unit time which may be cleared from the bit, given a number, size, disposition and orientation of a plurality of nozzles associated with the bit and under a selected flow rate of drilling fluid to be made available to the bit when drilling the at least one formation, selecting a rotational speed, determining a depth of cut required to generate the maximum volume of formation cuttings by the plurality of superabrasive cutters at the selected rotational speed and disposing the at least one exterior feature to preclude penetration of the at least one formation to a magnitude greater than the selected depth of cut.

42. A method of designing a bit for subterranean drilling, comprising:

determining a compressive strength of at least one formation to be drilled;

selecting a plurality of superabrasive cutters required on the bit under design to drill a borehole;

determining a total weight on bit required to cause the plurality of cutters to penetrate the at least one formation; and determining a sufficient surface area for at least one exterior feature on a leading end of the bit over which the plurality of cutters is mounted to support the bit thereon under at least the total weight on bit to maintain a unit load on the at least one formation less than a compressive strength thereof.

43. The method of claim 42, wherein the at least the total weight on bit comprises a greater weight than the total weight on bit.

44. The method of claim 42, further comprising selecting a depth of cut for the plurality of cutters and disposing the at least one exterior feature to preclude penetration of the at least one formation to a magnitude greater than the selected depth of cut.

45. The method of claim 44, further comprising determining a maximum volume of formation cuttings per unit time which may be cleared from the bit, given a number, size, disposition and orientation of a plurality of nozzles associated with the bit and under a selected flow rate of drilling fluid to be made available to the bit when drilling the at least one formation, and determining a maximum rotational speed required to generate the maximum volume of formation cuttings by the plurality of cutters at the selected depth of cut.

46. The method of claim 42, further comprising determining a maximum volume of formation cuttings per unit time which may be cleared from the bit, given a number, size, disposition and orientation of a plurality of nozzles associated with the bit and under a selected flow rate of drilling fluid to be made available to the bit when drilling the at least one formation, selecting a rotational speed, determining a depth of cut required to generate the maximum volume of formation cuttings by the plurality of cutters at the selected rotational speed and disposing the at least one exterior feature to preclude penetration of the at least one formation to a magnitude greater than the determined depth of cut.

47. A method of designing a bit for subterranean drilling, comprising:

determining a compressive strength of at least one formation to be drilled;

selecting a plurality of superabrasive cutters required on the bit under design to drill a borehole;

determining a total weight on bit required to cause the plurality of cutters to penetrate the at least one formation; and determining an area of at least one exterior surface feature on a leading end of the bit sufficient to preclude plastic failure of the at least one formation under at least the total weight on bit.

48. The method of claim 47, wherein the at least the total weight on bit comprises a greater weight than the total weight on bit.

49. The method of claim 47, further comprising selecting a depth of cut for the plurality of superabrasive cutters and disposing the at least one exterior feature to preclude penetration of the at least one formation to a magnitude greater than the selected depth of cut.

50. The method of claim 49, further comprising determining a maximum volume of formation cuttings per unit time which may be cleared from the bit, given a number, size, disposition and orientation of a plurality of nozzles associated with the bit and under a selected flow rate of drilling fluid to be made available to the bit when drilling the at least one formation, and determining a maximum rotational speed required to generate the maximum volume of formation cuttings by the plurality of superabrasive cutters at the selected depth of cut.

51. The method of claim 47, further comprising determining a maximum volume of formation cuttings per unit time which may be cleared from the bit, given a number, size, disposition and orientation of a plurality of nozzles associated with the bit and under a selected flow rate of drilling fluid to be made available to the bit when drilling the at least one formation, selecting a rotational speed, determining a depth of cut required to generate the maximum volume of formation cuttings by the plurality of superabrasive cutters at the selected rotational speed and disposing the at least one exterior feature to preclude penetration of the at least one formation to a magnitude greater than the determined depth of cut.

52. A method of drilling a subterranean formation, comprising:

engaging the formation with at least one cutter of a drill bit to a selected depth of cut; and maintaining the selected depth of cut during application of a weight on bit in excess of that required for the at least one cutter to penetrate the formation to the selected depth of cut by providing a bearing area on the drill bit to distribute the excess weight on bit sufficient to achieve a unit load by the bearing area on the formation less than a compressive strength of the formation.

53. A method of drilling a subterranean formation, comprising:

engaging the subterranean formation with at least one cutter of a drill bit to a selected depth of cut; and maintaining the selected depth of cut during application of a weight on bit in excess of that required for the at least one cutter to penetrate the subterranean formation to the selected depth of cut by providing a bearing area on the bit sufficient to support the drill bit on the subterranean formation without failure thereof.

54. The method of claim 53, further comprising maintaining the selected depth of cut under the excess weight on bit by supporting the bit on the subterranean formation without precipitating substantial plastic deformation thereof.

55. A method of drilling a subterranean formation, comprising:

applying a selected weight to cause at least one cutter of a drill bit to engage a formation to a selected depth of cut; and precluding subsequent penetration of the at least one cutter into the formation in excess of the selected depth of cut during application of a weight on bit greater than the selected weight by providing a bearing area on the drill bit to distribute the greater weight on bit sufficient to achieve a unit load by the bearing area on the formation less than a compressive strength of the formation.

56. The method of claim 55, further comprising maintaining the selected depth of cut under the greater weight on bit by supporting the bit on the formation without precipitating substantial plastic deformation thereof.

57. A method of drilling a subterranean formation, comprising:

applying a selected weight to cause at least one cutter of a drill bit to engage a formation to a selected depth; and precluding subsequent penetration of the at least one cutter into the formation in excess of the selected depth of cut during application of a weight on bit greater than the selected weight by providing a bearing area on the drill bit sufficient to support the drill bit on the formation without failure thereof.

58. A method of drilling a subterranean formation, comprising:

applying a first selected weight to cause at least one cutter of a drill bit to engage a first formation to a first selected depth of cut;

precluding subsequent penetration of the at least one cutter into the first formation in excess of the first selected depth of cut during application of at least the first selected weight;

applying a second selected weight different from the first selected weight to cause the at least one cutter of the drill bit to engage a second formation to a second selected depth of cut different from the first selected depth of cut; and precluding subsequent penetration of the at least one cutter into the second formation in excess of the second selected depth of cut during application of at least the second selected weight.

59. The method of claim 58, further comprising:

precluding subsequent penetration of the at least one cutter into the first formation in excess of the first selected depth of cut during application of more than the first selected weight; and precluding subsequent penetration of the at least one cutter into the second formation in excess of the second selected depth of cut during application of at least the second selected weight.

* * * * *